US005150663A

United States Patent [19]

Kobayashi

[11] Patent Number: 5,150,663

[45] Date of Patent: Sep. 29, 1992

[54] SIGNAL DEVICE FOR SMALL BOAT

[75] Inventor: Noboru Kobayashi, Hamamatsu, Japan

[73] Assignee: Yamaha Hatsudoki Kabushiki Kaisha, Iwata, Japan

[21] Appl. No.: 624,067

[22] Filed: Dec. 4, 1990

Related U.S. Application Data

[63] Continuation-in-part of Ser. No. 922,280, Oct. 23, 1986.

[30] Foreign Application Priority Data

Dec. 5, 1989 [JP] Japan ..... 1-317110

[51] Int. Cl.[5] ..... B63H 11/10

[52] U.S. Cl. ..... 116/209; 440/39; 441/71

[58] Field of Search ..... 116/28 R, 35 R, 56, 116/209, 211, DIG. 7; 441/71; 440/42, 39

[56] References Cited

U.S. PATENT DOCUMENTS

| | | | |
|---|---|---|---|
| 2,704,043 | 3/1955 | Drier | 116/211 |
| 3,020,568 | 2/1962 | Tierney | 441/71 |
| 3,052,899 | 9/1962 | Antoine . | |
| 3,077,616 | 2/1963 | Billingham | 441/71 |
| 3,229,312 | 1/1966 | Smith | 441/71 |
| 3,339,516 | 9/1967 | Lenci | 440/39 |
| 3,623,447 | 11/1971 | Jacobson . | |
| 3,685,068 | 8/1972 | Reed . | |
| 3,826,220 | 7/1974 | Jacobson | 440/42 |
| 4,598,661 | 7/1986 | Roe | 116/209 |
| 4,599,965 | 7/1986 | Johnson | 116/209 |
| 4,628,852 | 12/1986 | Nishida et al. | 440/42 |
| 4,635,580 | 1/1987 | Nishida | 114/56 |
| 4,681,058 | 7/1987 | Nishida | 114/56 |
| 4,699,596 | 10/1987 | Klinker et al. | 441/71 |
| 4,787,328 | 11/1988 | Inoue et al. | 440/39 |
| 4,832,632 | 5/1989 | Rogozienski | 440/39 |
| 4,850,908 | 7/1989 | Nakase et al. | 440/39 |

*Primary Examiner*—Thomas B. Will
*Attorney, Agent, or Firm*—Ernest A. Beutler

[57] ABSTRACT

Several embodiments of signalling devices for small jet propelled watercraft that generate an upwardly discharged water spray for indicating the presence of the watercraft. In each embodiment, devices are incorporated for precluding the discharge of the signal spray if desired. In some embodiments, this is done by a control valve while in other embodiments this is done by redirecting the discharge portion of the signal generating device. In all embodiments, however, the signalling device is permanently fixed within the discharge nozzle of the jet propulsion unit.

6 Claims, 6 Drawing Sheets

SIGNAL DEVICE FOR SMALL BOAT

CROSS REFERENCE TO RELATED APPLICATION

This application is a continuation in part of my application of the same title, Ser. No. 922,280, filed Oct. 23, 1986, pending, and assigned to the Assignee hereof.

BACKGROUND OF THE INVENTION

This invention relates to a signal device for a small watercraft and more particularly to an improved signal device for a jet propelled watercraft that can be selectively disabled.

As noted in my aforenoted copending application, a particularly popular type of small watercraft is powered by a jet propulsion unit. One difficulty with this type of watercraft, however, is that its means of propulsion does not generate the rooster tail normally associated with high performance propeller driven watercraft. As a result, the sighting of such small jet propelled watercraft from a distance can present some problems. In order to overcome these problems, it has been proposed to provide a signaling device that is positioned at the rear of the watercraft and particularly in the discharge nozzle of the jet propulsion unit for redirecting a portion of the water flow in an upward direction so as to provide a spray that will be visual at great distances.

Although the signaling device disclosed in my aforenoted copending application has high utility, there are some times in which it may not be desirable to provide the visual signal in the form of a spray. For example, this type of watercraft is frequently used in competition and the signal spray can be disadvantageous in competition use. Although devices have been proposed wherein the signalling arrangement is moveable between an operative position in the discharge nozzle and an inoperative position out of the discharge nozzle in order to control the generation of a spray, such moveable signaling devices are not particularly advantageous. Such moveable devices normally require modification of the jet propulsion unit per se and also can adversely effect the efficiency of the jet propulsion unit. Furthermore, the devices also can malfunction.

It is, therefore, a principal object of this invention to provide an improved signalling device for a small watercraft that can be selectively operated or disabled.

It is a further object of this invention to provide an improved signalling device for a small watercraft that affords permanent installation but which may, nevertheless, permit operator control of the spray signal.

SUMMARY OF THE INVENTION

This invention is adapted to be embodied in a signaling device for a jet propelled watercraft wherein the jet propulsion unit has an outer housing assembly defining a water inlet to receive water from a body of water in which the watercraft is operating, an impeller portion for containing an impeller for moving the water, and a discharge nozzle through which the water moved by the impeller is discharged. A signalling device is mounted in a fixed position in the discharge nozzle and has an inlet opening adapted to receive water moved by the impeller and an outlet opening configured so as to direct a water spray upwardly behind the watercraft to provide a visual signal. In accordance with the invention, means are incorporated for selectively precluding the upward discharge of water from the signalling device.

DETAILED DESCRIPTION OF THE PREFERRED EMBODIMENTS

Figure 1:
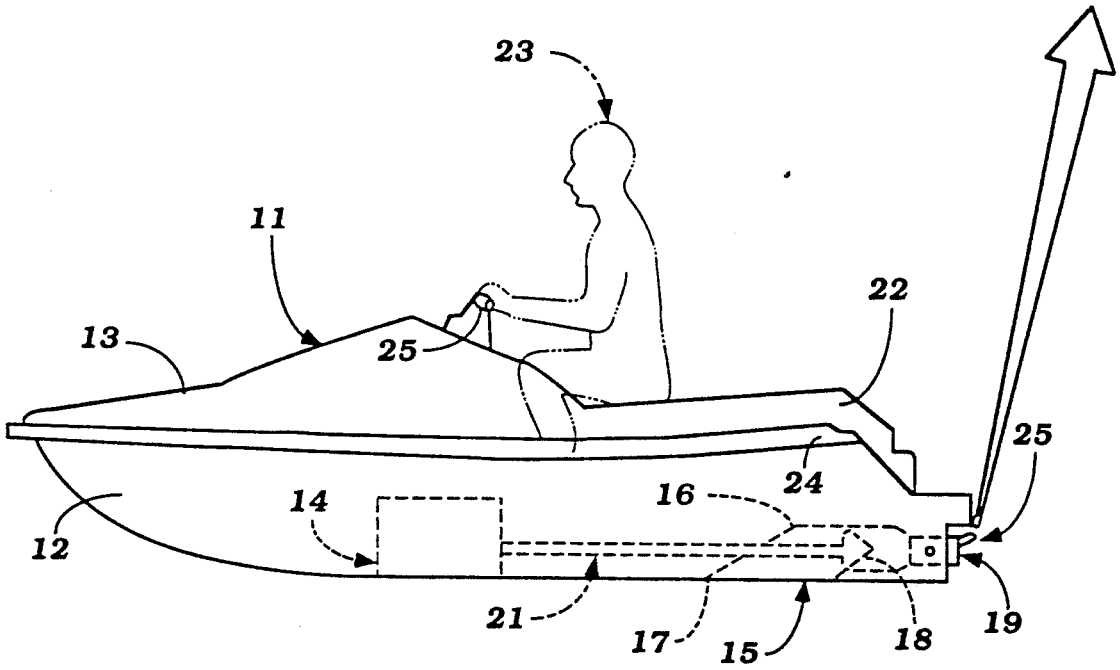
FIG. 1 is a side elevational view of a small watercraft embodying the invention.

Referring first in detail to FIG. 1, a small watercraft of the type that is adapted to embody the invention is identified generally by the reference numeral 11. The small watercraft 11 is comprised of a hull having a lower portion 12 and a deck 13, each of which may be formed from a suitable material such as a molded fiberglass reinforced resin. The hull 12 and deck 13 are affixed to each other in a suitable manner, as by bonding or the like.

An engine compartment is defined forwardly of the hull by the lower portion 12 and deck 13 and contains a powering internal combustion engine, indicated generally by the reference numeral 14 and which may be of any known type. Positioned rearwardly of the engine compartment and in the lower portion of the hull 12 is a jet propulsion unit, indicated generally by the reference numeral 15. The jet propulsion unit 15 is normally positioned within a tunnel formed at the rear of the hull and is comprised of an outer housing 16 having a downwardly and forwardly facing water inlet portion 17, an impeller portion in which an impeller 18 is rotatably journaled and a discharge nozzle, indicated generally by the reference numeral 19 which may include a pivotally supported steering portion. The jet propulsion unit 15 is driven from the engine 11 by means of a drive shaft 21 which is coupled in a known manner to the impeller 18.

A seat 22 is provided above the tunnel in which the jet propulsion unit 15 is contained and is adapted to accommodate one or more riders, one being shown in phantom at 23, seated thereon in straddle position. The hull is provided with a pair of raised gunnels 24 that define foot wells in which the rider's feet are positioned.

Forwardly of the seat 22, there is provided a mast 25 that carries a handlebar assembly for steering of the discharge nozzle 19 in a known manner. The aforedescribed construction may be considered to be typical of the type of watercraft in which the invention may be practiced. Of course, the invention can be employed with other types of jet propelled watercraft, but has particular utility in connection with the small sporting type watercraft illustrated.

The invention deals with a signalling device, indicated generally by the reference numeral 26, which is provided for creating a visual spray as shown by the arrow in FIG. 1 so as to permit visual recognition of the watercraft 11 from great distances. In accordance with the invention, however, the signal device 26 includes a mechanism by which the spray may be selectively disabled.

A first embodiment of the signalling device 26 is illustrated in FIGS. 2 through 5 and will now be described by particular reference to those figures. It should be noted that the signalling device 26 is provided with a mounting bracket 27 which permits the signalling device to be mounted permanently in the steering nozzle 19. In this regard, it should be noted that the device is described in conjunction with the mounting in a steering nozzle 19 which is, normally, supported for pivotal movement about a vertically extending steering axis. Of course, the invention can be employed where pivotally supported steering nozzles are not employed and the jet propelled watercraft is steered in other manners.

The signalling device 26 is comprised generally of a tubular member 28 that has an inlet opening 29 that faces upstream in the steering nozzle 19 so as to receive water under pressure from the impeller 18. An upwardly extending portion has a discharge opening 30 through which water will normally be discharged as shown in FIG. 1. However, in order to preclude the discharge of water, there is provided a control valve consisting of a butterfly type valve element 31 that is mounted in the discharge opening 30 adjacent its outlet end on a control valve shaft 32. The control valve shaft 32 is suitably journaled within the signaling device 26 and is rotatable between an open position as shown in the solid line views of FIGS. 2 and 4 and a closed position as shown in the phantom line view of FIG. 4. In this closed position, water will be precluded from being discharged from the opening 30 and no signal will be generated.

In order to permit an operator to selectively position the control valve 31, there is provided an actuating lever 33 that is affixed to an exposed end of the shaft 32. The lever 33 is normally biased to its open position by a biasing mechanism, indicated generally by the reference numeral 34 which is comprised of a coil compression spring 35 that is fixed at one end to a stop 36 carried by the discharge nozzle 30 and at its other end to one end of the lever 33 for biasing the lever 33 and valve 31 to its open position.

Figure 2:
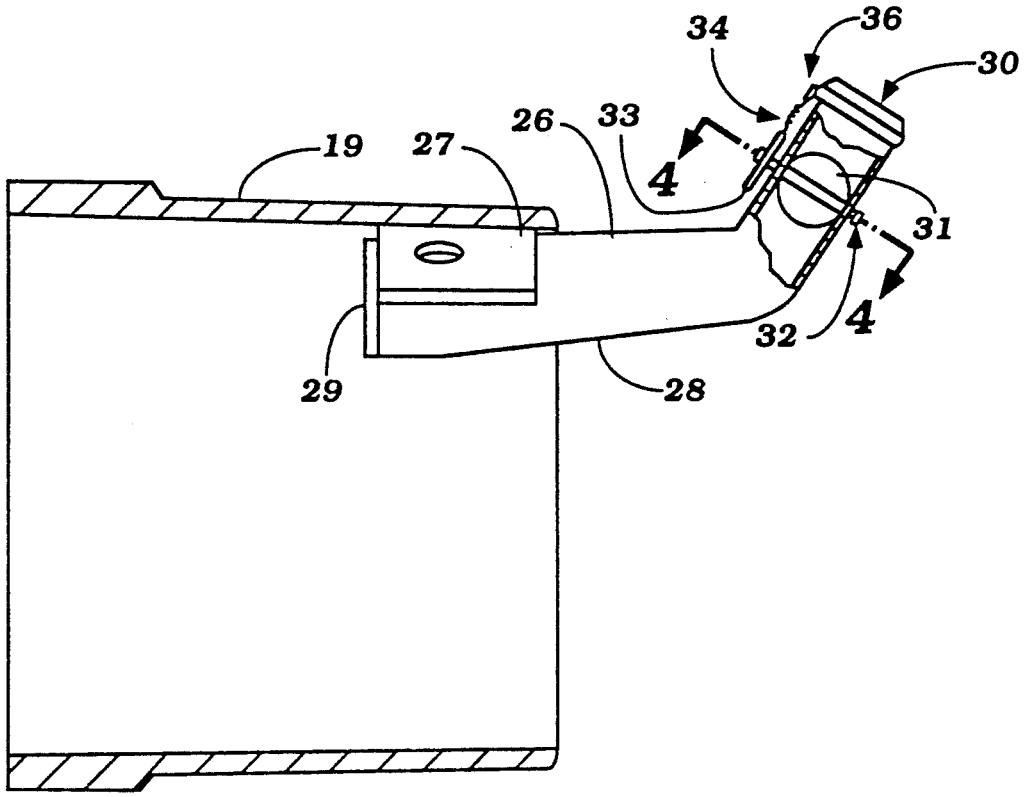
FIG. 2 is an enlarged cross sectional view taken through the discharge nozzle of the jet propulsion unit with a further portion broken away and showing a first embodiment of the invention.
Figure 3:
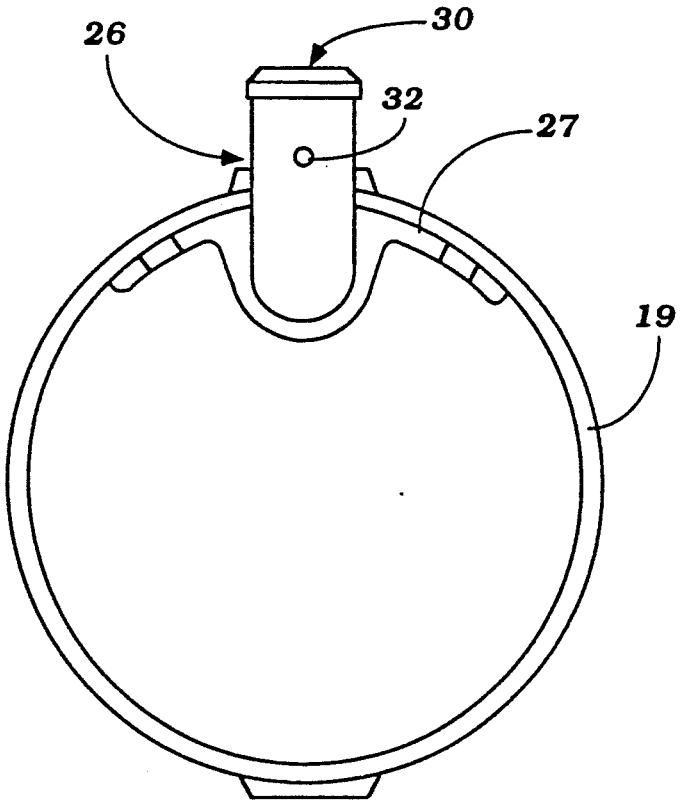
FIG. 3 is a rear elevational view of this embodiment.
Figure 4:
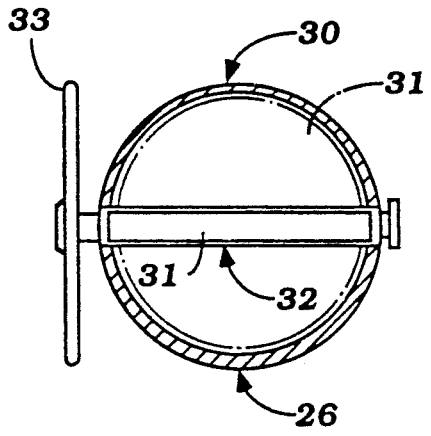
FIG. 4 is a cross sectional view taken along the line 4—4 of FIG. 2.
Figure 5:
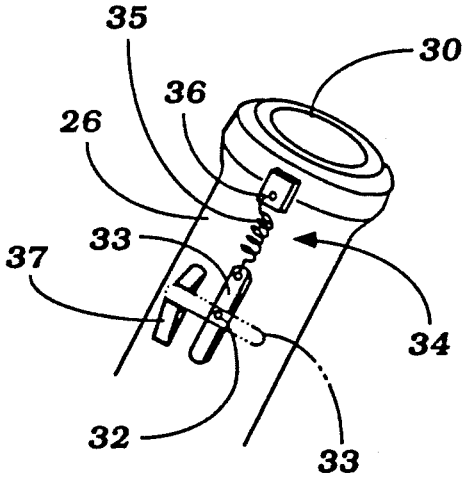
FIG. 5 is a perspective view showing a retaining device for holding the valve of this embodiment in either of its selected positions.

In the event the operator wishes to disable the spray or signal, the lever 33 is rotated from its open position to a closed position as shown in phantom in FIG. 2 where it is retained by a releasable latch or detent mechanism 37. As a result, the operator can easily select whether or not he wishes the signal spray to be generated.

Figure 6:
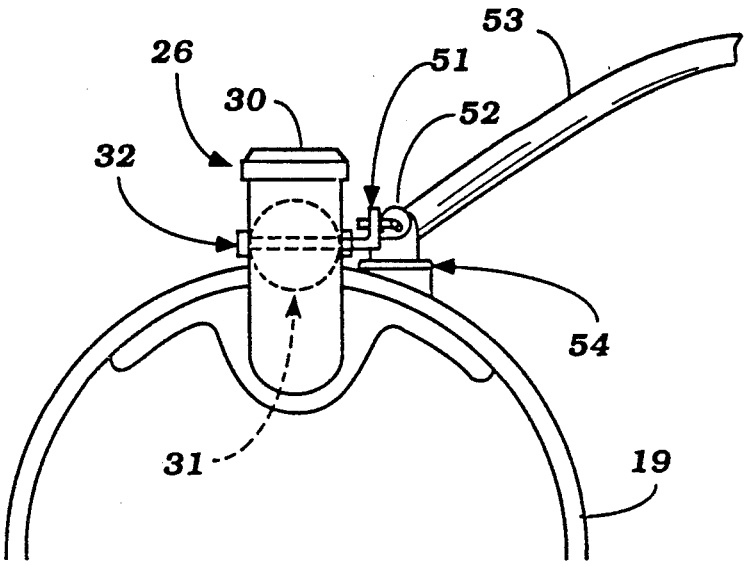
FIG. 6 is a rear elevational view, in part similar to FIG. 3, showing another embodiment of the invention.
Figure 7:
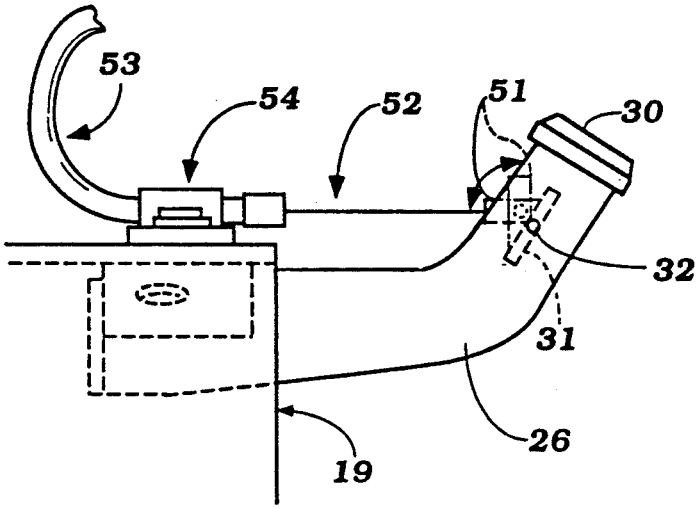
FIG. 7 is a side elevational view, in part similar to FIG. 2, of the embodiment of FIG. 6.

FIGS. 6 and 7 show another embodiment of the invention wherein the construction of the valve is the same as the embodiment of FIGS. 2 through 5. For that reason, components which are the same have been identified by the same reference numerals. In this embodiment, however, means are provided for permitting remote operation of the control valve 31 of the signalling device 26

In this embodiment, the control valve shaft 32 has an offset lever arm end 51 to which is connected one end of a wire actuator 52. The wire actuator 52 is contained within a protective sheath 53 and extends forwardly to an area near the mast 25 (FIG. 1) for operation by the rider 23. The protective sheath 53 is affixed to the discharge nozzle 19 by means of a mounting bracket 54. As should be readily apparent, movement of the remote control operator will effect reciprocation of the wire actuator 52 and movement of the control valve 31 from its open, signal generating position, to a closed, signal disabling position.

Figure 8:
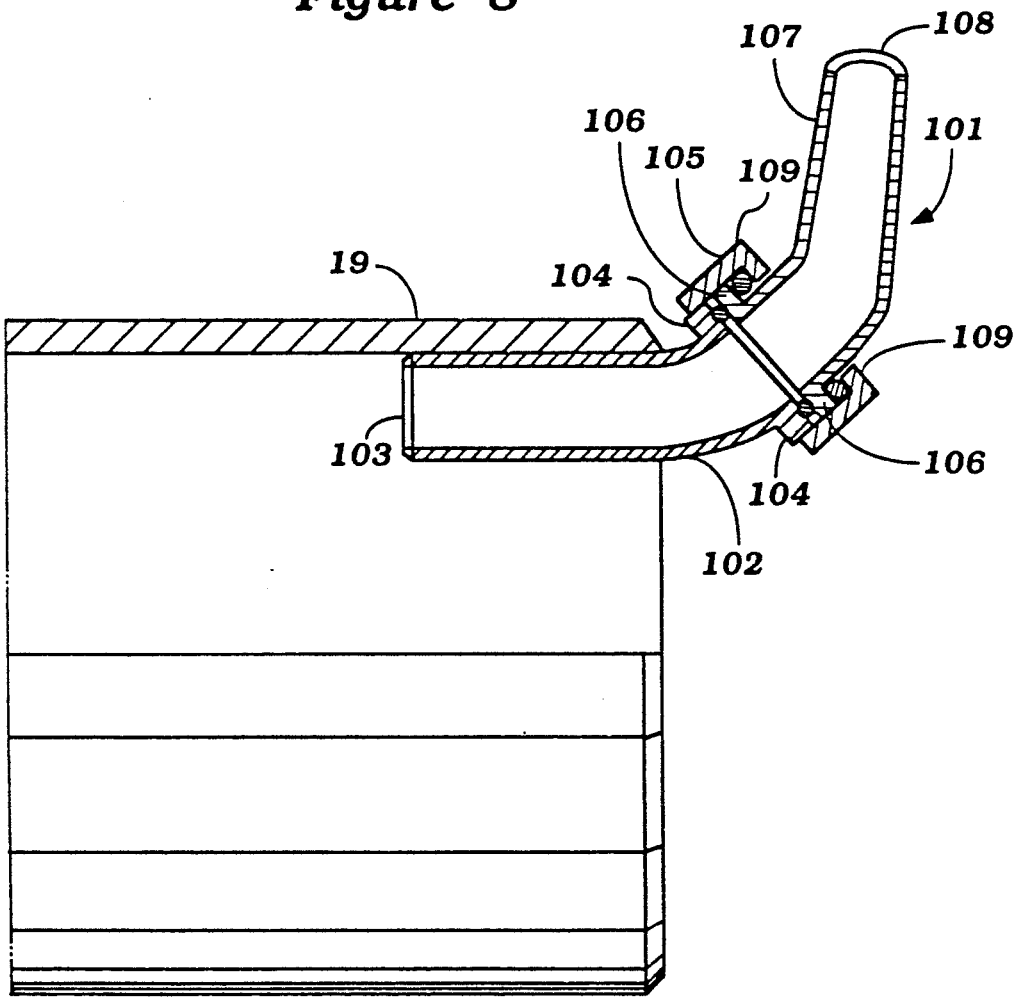
FIG. 8 is a cross sectional view, in part similar to FIGS. 2 and 7, and shows yet another embodiment of the invention.
Figure 9:
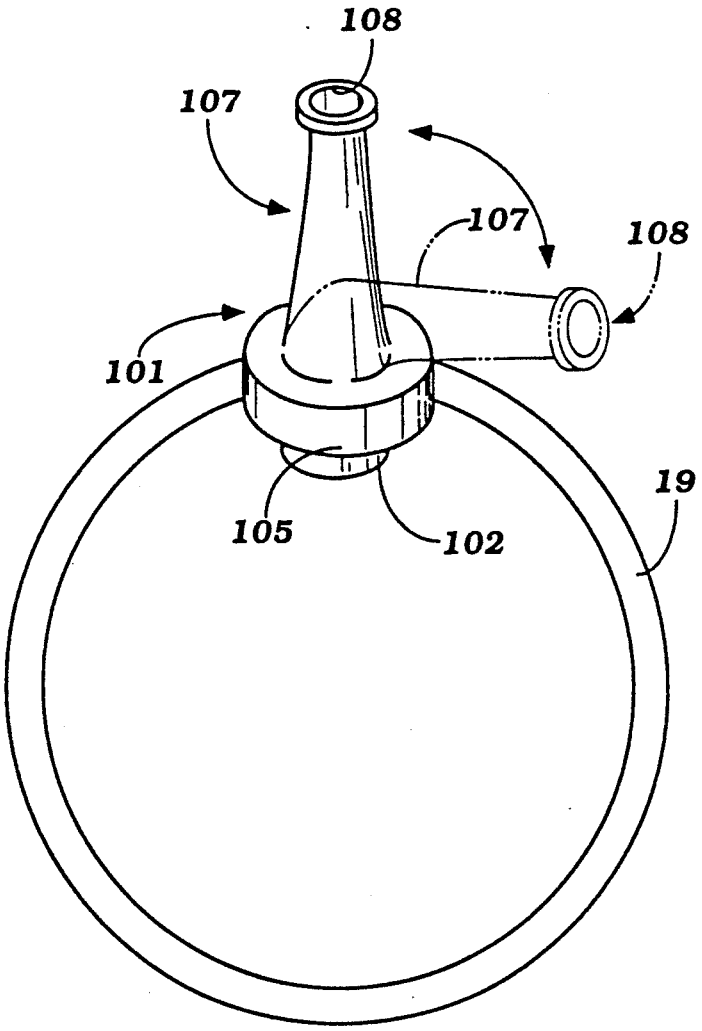
FIG. 9 is a rear elevational view of the embodiment of FIG. 8 showing the device in its spray or signal generating position in solid lines, and in its non signal generating position in phantom lines.

In the embodiments of the invention as thus far described, the control of the signal has been done by means of a control valve that selectively shuts off or enables the signal spray. It may also be possible to provide an arrangement wherein the spray is merely redirected so that a signal will not be generated. FIGS. 8 and 9 show such an embodiment. In this embodiment, however, it should be noted that the portion of the signalling device that extends into the discharge nozzle 19 is still fixed in position. Hence it is not necessary for this portion of the signalling device to be moveable relative to the discharge nozzle 19 and thus avoids the aforenoted defects of the prior art type of constructions.

In this embodiment, the signalling device is indicated generally by the reference numeral 101 and includes a fixed portion 102 that extends in fixed relationship to the discharge nozzle 19 and has an upstream facing inlet opening 103 that receives water from the impeller 18 under pressure.

A flange 104 is formed on the downstream end of the fixed nozzle portion 102 and receives a coupling 105 which also captures a flange 106 of a second rotatable portion 107 that has a discharge opening 108. O ring seals 109 are provided between the flanges 106 and 104 and the coupling 105 so as to provide against leakage and to provide sufficient frictional resistance to releasibly retain the rotatable portion 107 is position.

FIGS. 8 and the solid line view of FIG. 9 show the signalling device 101 in its signal generating position. In this position, the discharge opening 108 faces upwardly and a spray will be generated as shown in FIG. 1. If, however, the operator wishes to disable the spray, then the nozzle portion 107 is rotated to a side or downward position, the side position being shown in phantom in FIG. 9. The frictional resistance aforenoted in the coupling 105 is again retightened sufficiently to lock the portion 107 in this non signal generating position until the operator again rotates it to the signal generating position.

It should be readily apparent from the foregoing description that a number of embodiments of signal generating devices have been illustrated, each of which provides a visual signal for a small jet propelled watercraft when desired, but also which permits this signal to be disabled. This is done without requiring any component to move into and out of the discharge nozzle of the jet propulsion unit and thus permits a permanent installation which will not interfere with the normal operation of the jet propulsion unit. Although a number of embodiments of the invention have been illustrated and described, various changes and modifications may be made without departing from the spirit and scope of the invention as defined by the appended claims.

I claim:

1. A signalling device for a jet propelled watercraft having an outer housing assembly defining a water inlet to receive water from a body of water in which the watercraft is operating, an impeller portion containing an impeller for drawing water through said inlet, and a discharge nozzle through which water is discharged by said impeller for propelling said watercraft, a signalling device having an inlet opening fixed permanently within said discharge nozzle and adapted to receive water under pressure from said impeller and a discharge portion having an upwardly facing opening for upward discharge of water from said signalling device, and a butterfly type valve for precluding the upward discharge of water from said signalling device.

2. A signalling device as set forth in claim 1 further including means for remotely operating said butterfly type valve for selectively controlling the generation of a signal.

3. A signalling device as set forth in claim 1 further including actuating means mounted at the discharge nozzle for moving the butterfly type valve between a signal generating position and a non signal generating position under operator actuation.

4. A signalling device as set forth in claim 1 wherein the discharge nozzle of the jet propulsion unit is supported for pivotal movement about a generally vertically extending steering axis.

5. A signalling device as set forth in claim 4 further including means for remotely operating said butterfly type valve for selectively controlling the generation of a signal.

6. A signalling device as set forth in claim 4 further including actuating means mounted at the discharge nozzle for moving the butterfly type valve between a signal generating position and a non signal generating position under operator actuation.

* * * * *